United States Patent [19]

Schwarz

[11] 4,237,939

[45] Dec. 9, 1980

[54] STACKABLE TUBE BODY HAVING A LAYER OF SEALANT MATERIAL

[75] Inventor: Werner Schwarz, Reinach, Switzerland

[73] Assignee: H. Obrist & Co. AG, Reinach, Switzerland

[21] Appl. No.: 19,626

[22] Filed: Mar. 12, 1979

[30] Foreign Application Priority Data

Mar. 10, 1978 [CH] Switzerland ..... 2621/78

[51] Int. Cl.[3] ..... B65D 35/00

[52] U.S. Cl. ..... 138/109; 222/92; 206/515; 206/519

[58] Field of Search ..... 138/109, 178, 155; 222/92; 113/121 D; 206/515, 516, 519, 520, 503; 285/31; 277/207 A, 207 R; 220/8

[56] References Cited

U.S. PATENT DOCUMENTS 3,661,301 5/1972 Couland ..... 206/515 X 3,927,766 12/1975 Day ..... 206/519

FOREIGN PATENT DOCUMENTS 305586 10/1929 Belgium ..... 206/519

2009692 12/1971 Fed. Rep. of Germany .

2522511 12/1975 Fed. Rep. of Germany .

1395026 5/1975 United Kingdom ..... 206/519

*Primary Examiner*—James E. Bryant, III

*Attorney, Agent, or Firm*—Larson, Taylor & Hinds

[57] ABSTRACT

A stackable tapered tube body has an annular inwardly directed bead or corrugation in the region of the sealant layer. This provides that the tube bodies do not touch each other directly and that in particular the sealant layer is protected when tube bodies are stacked together.

The beads or corrugations are produced by the tube shell being gripped substantially over its entire periphery, and deformed.

6 Claims, 5 Drawing Figures

STACKABLE TUBE BODY HAVING A LAYER OF SEALANT MATERIAL

FIELD OF THE INVENTION

This invention relates to a stackable tapered tube body having an open end provided with a sealant material at an annular sealant section on the inside of the tubular body, for sealingly closing it. The invention also relates to a process for producing tube bodies of this kind, and to apparatus for carrying out this process.

Such tube bodies can be stacked so that they can be packaged in a particularly space-saving and rational manner for dispatch to the fillers. After the tubes have been filled, they are closed at their open ends in the region of the sealant layer, by being folded over.

PRIOR ART

Tubes of this kind are already known for example from DOS No 25 22 511 wherein the sealant material comprises a wax-like material. If the sealant layer comprises an adhesive material, problems arise when stacking the tube bodies in so far as the stacked tubes should not in any case come into contact with the sealant material of other tubes.

German patent specification No 2 009 692 discloses a tapered tube body of which the open end has an enlarged section with the same taper angle as the tube shell. The ring of sealant material is applied to the tube body in the interior of the enlarged section. The diameter of the enlarged section is such that the ring of sealant material does not come into contact with the next tube which is fitted into the first tube. The disadvantage to this configuration is that the tube walls are in direct contact with each other when the tubes are stacked one within the other. This causes the tubes to stick strongly together so that it is difficult to separate them from each other and, in addition, there is the possibility of damage to the surface of the tube, to which printing may already have been applied. A further disadvantage of the enlarged end of the tube is that outwardly projecting edges are formed relative to the tube body when the enlarged end portion is folded over. Sharp-edged projections of this kind can easily result in injury and are also unattractive in appearance. The enlarged tube portion also causes some difficulties in production, as longitudinal tears can occur at the end of the tube in the operation required for greatly expanding the tube end.

An object of the present invention is in particular to avoid the disadvantages of the known art and to provide a stackable tube body which is easy to produce, which permits the tube bodies to be stacked without detriment thereto, and in which, moreover, the open end of the tube is increased in strength.

SUMMARY OF THE INVENTION

The present invention provides a stackable tapered tube body having an open end, and a sealant material for sealingly closing said open end, at an annular sealant section on the inside of the tube body, the material of said tube body in at least one portion of the body being deformed inwardly towards the axis of the tube to protect the sealant material when stacking the tubes, the inside diameter of this deformed portion being smaller than the inside diameter of the end region of said sealant layer adjacent said deformed portion.

This inwardly directed deformation portion protects the directly adjacent sealant section from contact with the tube body inserted therein. In addition this deformation portion also ensures that the tube walls of the stacked tube bodies do not come directly into contact with each other. This protects the surfaces of the tubes from damage, prevents lacquer coatings from possibly sticking together, and facilitates separation of the tubes.

In order to protect the sealant section from being unintentionally squeezed together, it is particularly advantagous, in accordance with a further feature of the invention, for the deformation portion to be disposed between the sealant section and the open end of the tube. It will be seen that, with such an arrangement, the sealant section is always protected, even when the tubes are stacked.

The invention may be embodied in a particularly simple and advantageous manner if the deformation portion is in the form of an annular corrugation or bead. The advantage of such a configuration lies in the strengthening and stiffening action in respect of the entire marginal portion at the mouth opening of the tube.

If the width of the corrugation or bead is at least 1 mm, the inside diameter can be approximately so dimensioned that there is an appropriate space between the stacked tube shells without the corrugation or bead having to be of excessively small radius. It will be appreciated that the depth of the bead or corrugation is such that the deformation portion is raised above the thickness of the layer of sealant material. This stipulation also applies when the bead or corrugation is not of semicircular cross-section. The bead or corrugation may also be for example of an approximately trapezoidal cross-section. There is no danger of crack formation in the bead or corrugation according to the invention, as the tube casing is not expanded, but is upset, upon being deformed inwardly.

In accordance with a further feature of the invention, the deformation portion comprises two annular beads or corrugations which are arranged on both sides of the sealant section. The second bead or corrugation provides additional protection in regard to loads acting radially on the tube shell from the exterior.

Tube bodies of this kind are generally made into their tapered configuration, in a single working operation. It would be theoretically possible for the annular deformation portions to be produced together with the taper-producing operation. However, in order to make the process of producing the tube bodies flexible and in order to make it possible to take account of particular customer requirements, it is advantageous for the working operations to be separated and, in some cases, even for the deformation portions to be formed only at the end of the process, that is to say, after application of the sealant material layer. However, this involves particular problems in manufacture as the layer of sealant material makes it difficult to grip or centre the tube body. Thus for example there is no possibility of producing the depressions in the tube body by rolling as it is not possible for a suitable mounting to be inserted into the tube.

Therefore, a further object of the invention is to provide a method whereby tube bodies of the kind set out above can be deformed without the tube being damaged in the deformation operation, without a special co-operating mounting having to be inserted into the tube, and without any layer of sealant material which has already been applied impeding the working process. This object is attained in accordance with the invention in that the tube is gripped from the outside in the region to be deformed substantially over the entire periphery thereof and is deformed in at least one portion of the periphery.

Gripping the tube shell over its entire periphery means that it is possible to produce a deformation portion, without damage to the unstable and flexible tube body. It is not necessary to provide a mounting or pressing jig in the interior of the tube as the tube cannot be distorted because it is gripped on all sides at its periphery.

A still further object of the invention is to provide apparatus for deforming a tapered tube body, which permits recess portions to be produced in the tube shell, particularly when a layer of sealant material is already present in the shell. This object is achieved in that apparatus according to a further aspect of the invention has a mounting mandrel for holding the tube body, the diameter of which mandrel being adapted to the inside diameter of the tube at least in the front region and the outside diameter of the mandrel being smaller than the inside diameter of the tube in the region of the portion of the tube which is to be deformed. The mounting mandrel has support means for supporting the open end of the tube, and at least three concentrically closable jaws for forming the deformation portion are arranged around the mounting mandrel, the surface of the jaws which is towards the wall of the tube being adapted in the closed condition to the desired configuration of the deformation portion.

It will be appreciated that, by virtue of the particular configuration of the mandrel, the tube is held in its forward region by interengagement of shapes, while it does not lie against the mandrel in the region of the deformation portion. This ensures that the layer of sealant material, if already applied to the tube body, does not come into contact with and stick to the holding mandrel. The support means at the open end of the tube ensures that the end of the tube can be easily opened out. The concentrically closable jaws make it possible to produce a deformation portion of any desired configuration, without causing damage to the relatively unstable and flexible tube body. The open end of the tube can be opened out in a particularly satisfactory manner if the support means is a frustoconical portion displaceable on the mandrel in the axial direction. In this way, even tube bodies which are easily upset are restored again to a precisely conical starting condition. The possibility of adjustment of the support means on the mandrel ensures precise control of the degree of enlargement of the tube body. The enlarged portions at the end of the tube facilitate subsequently separating the stacked tubes.

The holding mandrel is provided with ejection means for more easily removing the tube body from the apparatus. The ejection means can be embodied in a particularly simple manner if it comprises a bore in the holding mandrel, which bore can be supplied with compressed air. It will be appreciated that a short compressed air blast is sufficient to eject the tube from the apparatus. The advantage of this ejection means is that it does not require any movable components.

The jaws of the apparatus may be displaced in a particularly simple manner if they are surrounded by a common closure ring which is displaceable in the axial direction and which has a conical inside wall for simultaneously compressing the jaws. This arrangement ensures that all the jaws are pressed against the tube shell simultaneously and with the same force. In a particularly advantageous arrangement, the jaws are also provided with a corresponding conical configuration on their outside wall. The closing stroke movement of the jaws may be determined in a particularly simple manner in this arrangement, by a suitable selection of the angle of inclination of the cone configuration. This manner of actuating the jaws also ensures that mechanically simple actuating means can be used.

DESCRIPTION OF PREFERRED EMBODIMENTS

Figure 1:
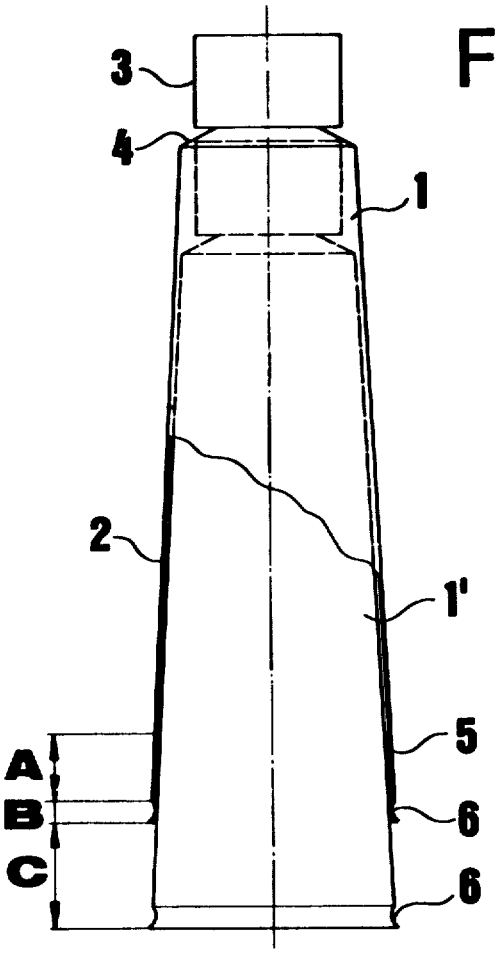
FIG. 1 is a view partly in section of two tube bodies having the features of the invention, which are stacked one within the other.
Figure 2:
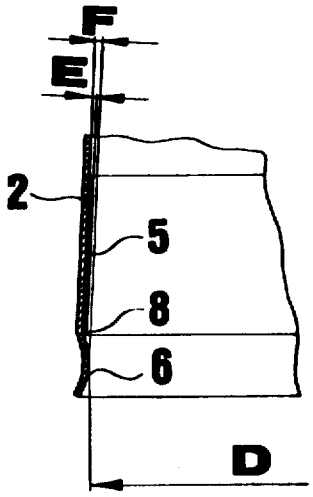
FIG. 2 is a view to an enlarged scale of part of the tube opening.

Referring to FIG. 1, a tube body 1 comprises a tapered tube shell 2 which terminates at one end in a shoulder 4 to which a closure cap 3 may be secured. When such tube bodies are stacked one within the other, the closure cap 3 of one tube lies against the shoulder 4 of the other. The stacking graduation distance C is fixed by the height of the closure cap 3. At the other open end of the tube, a layer 5 of sealant material, of thickness E and width A, is applied to the tube body in an annular sealant section. The layer of sealant material may comprise for example acrylic resin dispersion or other suitable material. Beyond the sealant layer, the end of the tube is provided with an inwardly directed bead or corrugation 6 of width B and of inside diameter D smaller than the inside diameter of the end region 8, which is adjacent the deformation portion of the sealing layer. This dimensioning ensures that the sealant layer does not come into contact with a tube inserted therein, whatever the taper angle. The bead or corrugation 6 has a deformation portion of depth F, this deformation portion rising above the layer thickness E of the sealant layer, by the dimension F less the dimension E.

By virtue of this arrangement, the inserted tube 1' is supported on the one hand at the shoulder 4 and on the other hand at the bead or corrugation 6. However, in order to facilitate subsequently separating the tubes, a clearance should be provided between the bead 6 of diameter D and the inserted tube. The space between the tube bodies 1 and 1' is dependent on the taper angle, the distance C and the inside diameter D of the bead. The bead 6 strengthens the end of the tube in such a way that the tubes, when stacked together, can not be unintentionally squashed together in the sealant region A.

Figure 3:
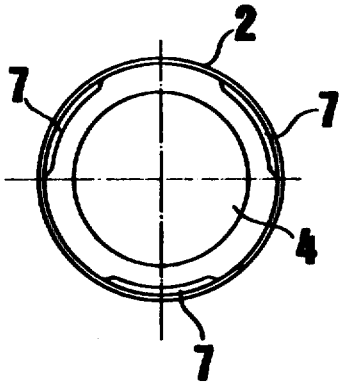
FIG. 3 is an end view of a modified embodiment with partial recess portions.
Figure 4:
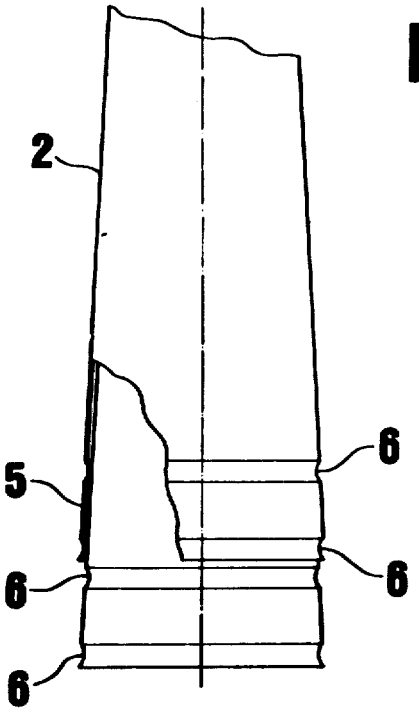
FIG. 4 is a view of a further embodiment with two annular beads or corrugations.

It will be appreciated that other configurations are also possible, without thereby departing from the scope of the invention. FIG. 3 shows a modified embodiment wherein the deformation portion comprises three partial depressions 7 which are disposed in the same plane. In FIG. 4, two deformation portions 6 are provided, one above and one below the sealing section 5.

The deformation portion may also be formed as a step-like recess. The sealant region A, the width B of the bead or corrugation 6 and the stacking graduation distance C can be varied as desired, according to circumstances and tube configuration. Selecting the correct thickness for the layer 5 is readily possible for the man skilled in the art, and will not be specified in greater detail herein.

Figure 5:
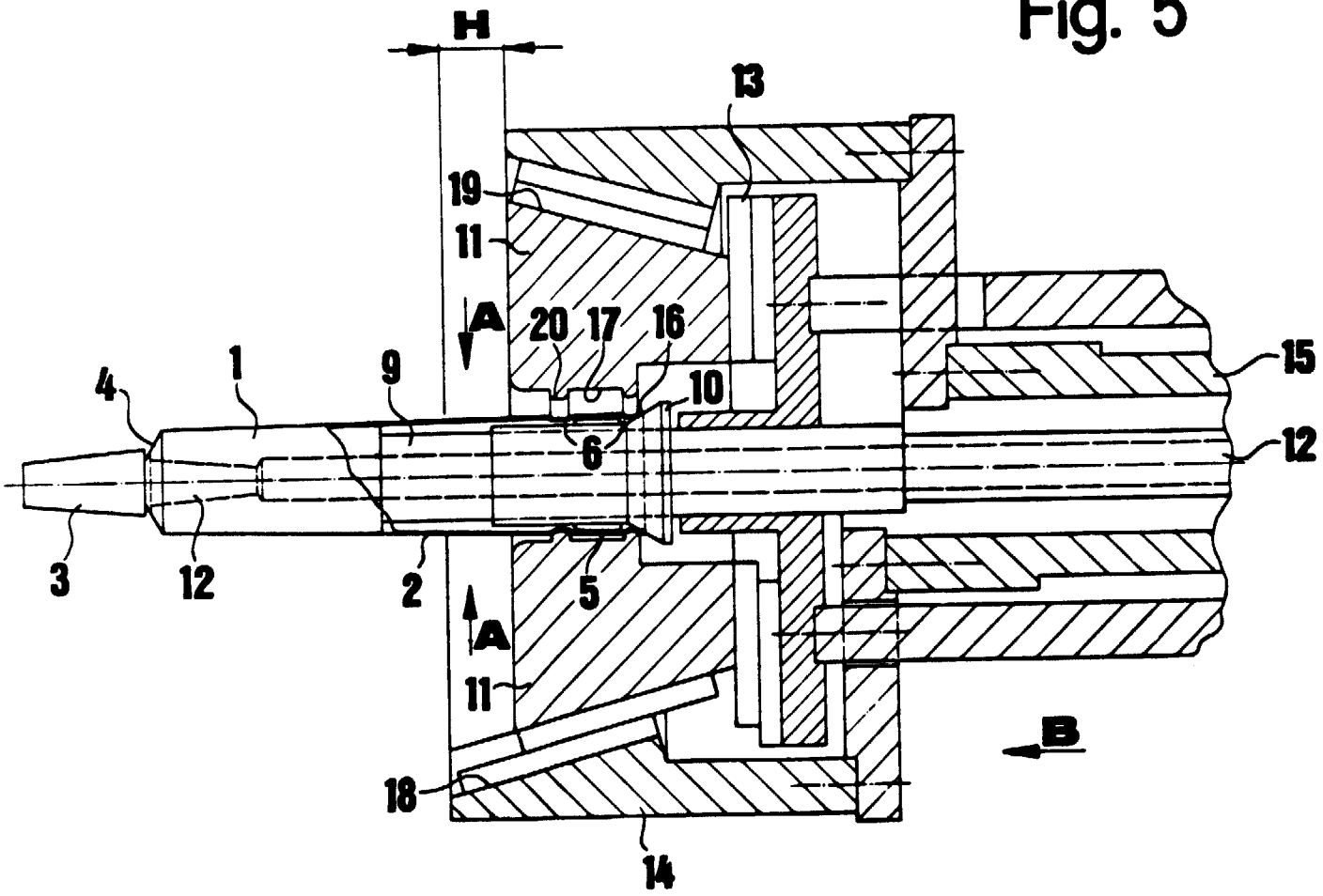
FIG. 5 is a view, in partial cross-section and in simplified form, of apparatus for producing the beads or corrugations.

Preferred apparatus for producing deformation portions in the stackable tube according to the invention is shown in FIG. 5.

As shown, the tube body 1 is held by a holding mandrel 9 which is adapted in its forward region to the inside diameter of the tube. This forward region preferably extends over at least one third of the tube length. In contrast, the outside diameter of the mandrel 9 in the region of the deformation portion and in the region of the sealant layer 5 is smaller than the inside diameter of the tube. In this way the holding mandrel 9 does not come into contact with the sealant layer 5. The tube bodies are pushed on to the holding mandrel 9 by feed means (not shown), as far as the shoulders 4. For this operation, the closure cap 3 has already been screwed on to the tube body. The holding mandrel 9 is provided over its entire length with a bore 12 through which compressed air can be blown for ejecting the tube body.

A support means 10 which is advantageously in the form of a frustoconical member or a spherical cup is provided for supporting and flaring the open end 16 of the tube. So that the support means can be adapted to different tube lengths, the support means is displaceable on the mandrel 9. When the tube body 1 is pushed on to the mandrel 9, the open end 16 of the tube is slightly flared against the conical support means 10. The support means 10 is so set that the open end of the tube 16 is reliably supported in any case, even with tolerance fluctuations in the tube length. Opening out the end of the tube has the advantage that the stacked tubes can be more easily separated at a later time.

Jaws 11 are mounted in and are radially displaceable in jaw guide means 13 (not shown in great detail). It has been found particularly advantageous for three concentrically displaceable jaws to be used for forming the deformation portion. Obviously however, it is also possible to use a larger number of jaws. The jaws are actuated by a common closure ring 14 which embraces all the jaws 11 and is connected to a push rod 15. The ring 14 has a tapered inside wall 18 by which the jaws 11 are pushed together concentrically in the direction indicated by the arrow A. This is effected by axial forward movement of the ring 14 in the direction indicated by arrow B, by means of the rod 15. Upon the ring 14 covering the stroke distance H, the jaws 11 which are fixed in the axial direction and which are mounted in the jaw guide means 13, are pressed together. The drawing shows, above the centre line in FIG. 5, the apparatus in the starting position, while below the centre line the apparatus is shown with the jaws 11 in the inwardly displaced pressure-applying position. The force required for actuating the rod 15 is produced by actuating means (not shown) which preferably comprises a hydraulic or pneumatic jack. The outside walls 19 of the jaws are also of a tapered configuration. With such an arrangement, an axial force component, by virtue of the forward movement of the ring 14, is converted into a radial force component, in a particularly simple manner. It will be appreciated that the jaws can also be actuated in a different manner. For example, it would be possible for the individual jaws to be moved on the jaw guide means, by means of toothed racks and bevel gears.

The surfaces 17 of the jaws, which are towards the tube casing, are provided with projections 20 which produce the desired beads or corrugations on the tapered tube casing, when the jaws are pressed towards each other. The projections 20 can be of any desired configuration. The tube casing is not in contact with the mandrel 9 at any point in this region, even after the circular beads 6 have been pressed into the casing.

The process and apparatus provide for rational and flexible production of tapered tube bodies of the aboveindicated kind.

For other tube sizes, it is only necessary to replace the mandrel 9 or the jaws 11. Jaws 11 with different jaw surfaces 17 can also be used, depending on the nature and kind of the sealant layer 5.

What is claimed is:

1. A stackable tapered tube body having an open end, and a sealant material for sealingly closing said open end, at an annular sealant section on the inside of the tube body wall, the material of said tube body wall in at least one relatively minor portion of the body wall being deformed inwardly towards the axis of the tube to protect the sealant material when stacking the tubes, the inside diameter of this deformed portion being smaller than the inside diameter of the end region of said sealant layer adjacent said deformed portion, and smaller than the inside diameter of that part of the relatively major portion of the tube body which immediately adjoins said deformed portion on the side thereof away from said open end.

2. A tube body as defined in claim 1, wherein the inwardly deformed portion is disposed between the sealant section and the open end of the tube.

3. A tube body as defined in claim 1 wherein the inwardly deformed portion comprises an annular bead or corrugation standing proud relative to the configuration of the major portion of the wall of the tube body.

4. A tube body as defined in claim 3, wherein the width of the annular bead or corrugation is at least 1 mm.

5. A tube body as defined in claim 1 wherein the deformed portion comprises at least two partial recesses disposed in the same transverse plane.

6. A tube body as defined in claim 1 wherein the deformed portion comprises two annular beads or corrugations arranged one on each side of the sealant section.

* * * * *